US008101878B2

(12) United States Patent
Yang

(10) Patent No.: US 8,101,878 B2
(45) Date of Patent: Jan. 24, 2012

(54) GU24 3-WAY DIMMER KNOB-TYPE SWITCH LAMPHOLDER

(75) Inventor: Wen-Ho Yang, Taipei County (TW)

(73) Assignee: Goldweal Far East Ltd., Dongguan, Guangdong (CN)

( * ) Notice: Subject to any disclaimer, the term of this patent is extended or adjusted under 35 U.S.C. 154(b) by 232 days.

(21) Appl. No.: 12/659,045

(22) Filed: Feb. 24, 2010

(65) Prior Publication Data

US 2011/0203909 A1 Aug. 25, 2011

(51) Int. Cl.
*H01R 33/95* (2006.01)

(52) U.S. Cl. ..... 200/51.17; 439/220; 439/614; 439/602; 439/667

(58) Field of Classification Search ..... 200/51.17, 200/51.06, 51.08, 51.11, 574; 439/220, 224, 439/241, 611, 614, 616, 619, 662, 672
See application file for complete search history.

(56) References Cited

U.S. PATENT DOCUMENTS

| | | | | |
|---|---|---|---|---|
| 5,113,044 | A * | 5/1992 | Tomberlin | 200/51.04 |
| 6,227,912 | B1 * | 5/2001 | Hung | 439/620.02 |
| 6,979,230 | B2 * | 12/2005 | Cherian | 439/662 |
| 7,478,926 | B2 * | 1/2009 | Huang | 362/249.01 |
| 7,491,077 | B1 * | 2/2009 | Yang | 439/241 |
| 7,521,641 | B2 * | 4/2009 | Huang | 200/336 |

* cited by examiner

*Primary Examiner* — Xuong Chung Trans
(74) *Attorney, Agent, or Firm* — Bacon & Thomas, PLLC

(57) ABSTRACT

A GU24 3-way dimmer knob-type switch lamp holder is disclosed, where the body of the lamp holder is provided with three contact plates at the two sides of its interior and on its bottom. And an insulating rotor and a rotor conducting plate therein is driven by a knob. The rotor conducting plate is shaped into four portions along its rim, where three of them come with a shaped contact plate, while the fourth is void. The insulating rotor and the rotor conducting plate are driven to rotate by turning the knob, which enables three contact plates in the body and three contact plates of the rotor conducting plate to form no conduction or different conduction modes that enable various levels of illumination: dim, moderate and high brightness after power ON and feature power OFF as well.

2 Claims, 9 Drawing Sheets

GU24 3-WAY DIMMER KNOB-TYPE SWITCH LAMPHOLDER

BACKGROUND OF THE INVENTION

1. Field of the Invention

The present invention relates generally to a GU24 3-way dimmer knob-type switch lamp holder and more specifically to one capable of regulating the light into three states of illumination: dim, moderate and high brightness.

2. Description of the Prior Art

A lamp holder is the means used for offering the assembly and support of an illuminating article (for instance: light bulbs). Prior lamp holders feature only the turning ON and OFF of the electricity to the light bulb, rather than light level control of the illuminating article. As people care about energy saving and environmental protection gradually, more and more users demand various levels of energy saving from lamp holders. To cater to the market demand, a number of lamp holders featuring adjustment of luminance are emerging in time. Prior dimmer lamp holders adjust the luminance of illuminating articles, subject to the change of electric voltage or resistance; however, this manner of adjusting the luminance is especially fit for the high electricity consuming incandescent lamps. And it won't be suitable for high brightness and energy saving lamps such as GU24 energy saving fluorescent lamps and FL fluorescent lamps. The reason for that lies in that the GU24 energy saving fluorescent lamps and FL fluorescent lamps have a high activating voltage, where the GU24 energy saving fluorescent lamps and FL fluorescent lamps tend to put out once the adjustment of luminance is by lowering the voltage; therefore, it is essential to develop GU24 dimmer energy saving lamp holders specifically for the GU24 energy saving fluorescent lamps and FL fluorescent lamps, which is targeted at magnifying adaptation to the lamp specifications and at satisfying consumer demands.

SUMMARY OF THE INVENTION

In the light of the above drawbacks, this inventor conceived the idea for the research and development, and eventually the longtime endeavors gave birth to this invention.

An objective of the present invention is therefore to provide a GU24 3-way dimmer knob-type switch lamp holder that features regulating the light into three states of illumination: dim, moderate and high brightness.

Another objective of the present invention is to provide the GU24 3-way dimmer knob-type switch lamp holder that is compatible with a GU24 3-way dimmer energy saving fluorescent lamp.

A further objective of the present invention is to provide the GU24 3-way dimmer knob-type switch lamp holder that offers a adapter assembled with the lamp holder that is compatible with PL fluorescent lamps.

To achieve the aforementioned objectives, the 3-way dimmer knob-type switch lamp holder of this invention comprises:

a body, having a joining surface at its bottom, where the joining surface is provided with a set of guiding troughs to be inserted firmly by conducting poles of the GU24, and having a circular through trough at its center and a broadened shallow trench connected for the positioning purpose. The body is provided with a plurality of lodging troughs for lodging an anode clasping plate, an electrode clasping plate, a first conducting plate, an electrode conducting plate, a second conducting plate, a rotor conducting plate, a third conducting plate and an insulating rotor, where the rotor conducting plate forms a cavity by a side wall and a curved wall. The curved wall is divided into four parts, where three of them are arranged into ratchet form, which are shaped orderly into a first contact plate, a second contact plate and a third contact plate, and the forth part is void. The insulating rotor is accommodated in the cavity of the rotor conducting plate in a firm combination, where its outer wall is arranged into ratchet form which is shaped into a first ratchet, a second ratchet, a third ratchet and a fourth ratchet. The first ratchet, the second ratchet and the third ratchet correspond to the first contact plate, the second contact plate and the third contact plate respectively, and the fourth ratchet corresponds to the gaping void. The anode clasping plate is provided with a contact plate that joins the curved wall of the rotor conducting plate, while the electrode clasping plate joins the electrode conducting plate. One end of the electrode conducting plate is shaped into a curved joining portion, which is placed inside a guiding trough during the assembly. The first conducting plate is provided with a contact plate that joins the curved wall of the rotor conducting plate, and the first conducting plate joins the second conducting plate. One end of the second conducting plate is shaped into a curved joining portion, which is placed inside another guiding trough during the assembly. The third conducting plate is provided with a contact plate that joins the curved wall of the rotor conducting plate, and the third conducting plate is connected fixedly to the circular trough by means of a linking piece, where the linking piece joins a contact plate for the conduction purpose on the joining surface, to have the contact plate positioned in the shallow trench. The body is provided with a slot at its one side and with a fastening hole at each of two sides of the interior. A driving shaft is connected to the center of the insulating rotor with its one end for a firm combination, while the other end of the shaft to a knob. And the driving shaft is placed in the slot during the assembly;

a fixing member, having two opposite portions on its rim protruded into forming clamping hooks, is provided with a set of through holes and a set of cord holes at its top surface. The fixing member is to put on top of the body, and a set of fastening articles are used to penetrate the set of through holes respectively and are joined to the corresponding fastening holes of the body; and a top cover, having a clamping trough at each of the two sides of its outer wall corresponding to the clamping hook of the fixing member. Once the top cover is placed right on top of the body with the fixing member in position, the clamping hooks are inserted for clamping by the corresponding clamping troughs. The top cover is provided with a connecting hole for joining with a supporting lamp frame and for the passing through by the power cord;

When in use, through the turning of the knob, the driving shaft is able to drive the insulating rotor to rotate synchronously with the rotor conducting plate, which alters the relative contacts between the four portions of the rotor conducting plate: first contact plate, the second contact plate, the third contact plate and the void and the three objects: the contact plate of the anode clasping plate, the contact plate of the first conducting plate and the contact plate of the third conducting plate. The joining portion in the guiding trough of the joining surface of the body and the contact plate joined with the linking piece work together with the lamp to feature the adjustment of the light into three states of illumination: dim, moderate, and high brightness and power OFF.

DETAILED DESCRIPTION OF THE INVENTION

To achieve the aforesaid objects of the present invention, the technique adopted and the function achieved are detailed described with reference to the following preferred embodiments and the accompanying drawings, which would give a thorough comprehension on the present invention.

Figure 1:
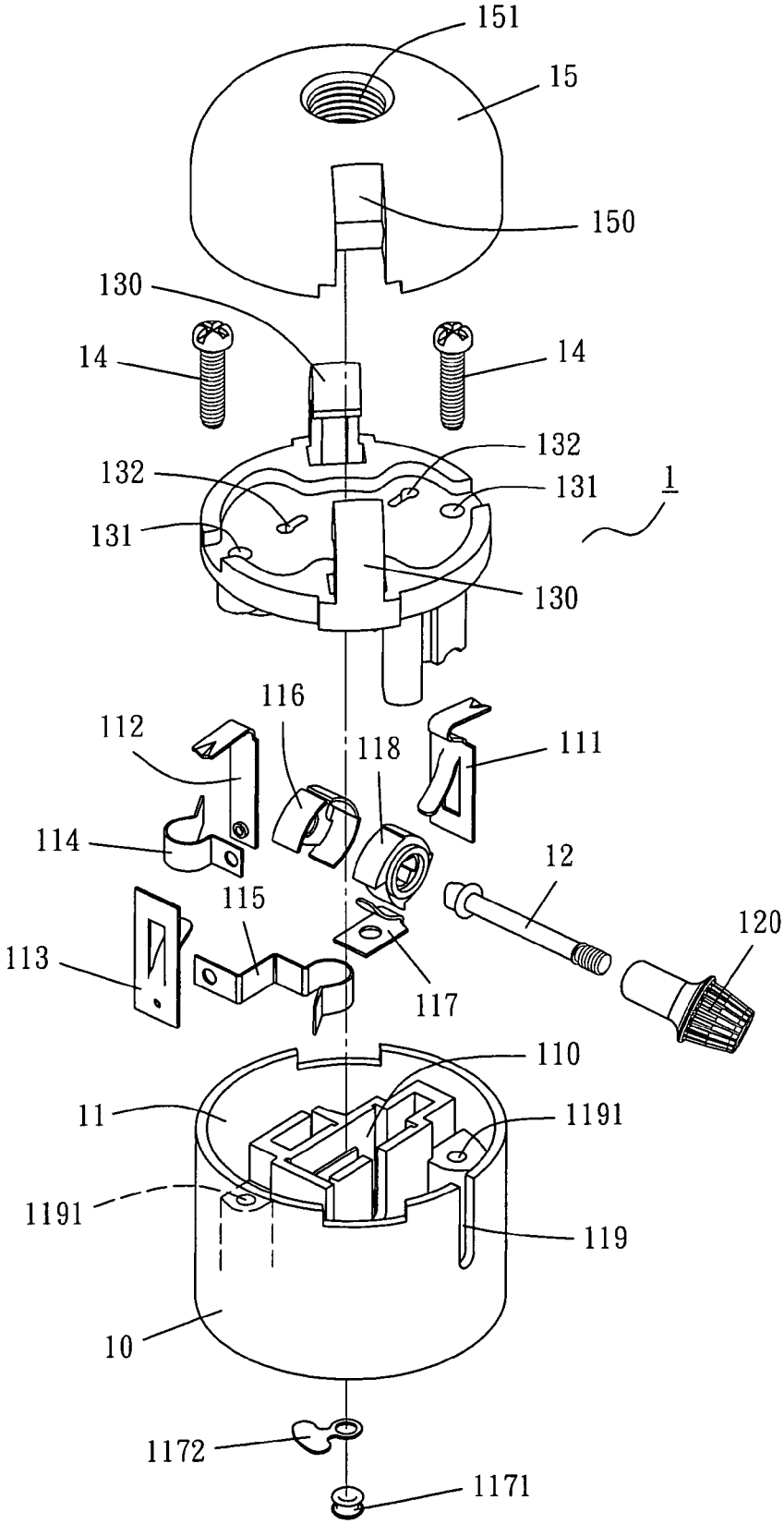
FIG. 1 is a three-dimensional exploded view of the exemplary embodiment of this invention.
Figure 2:
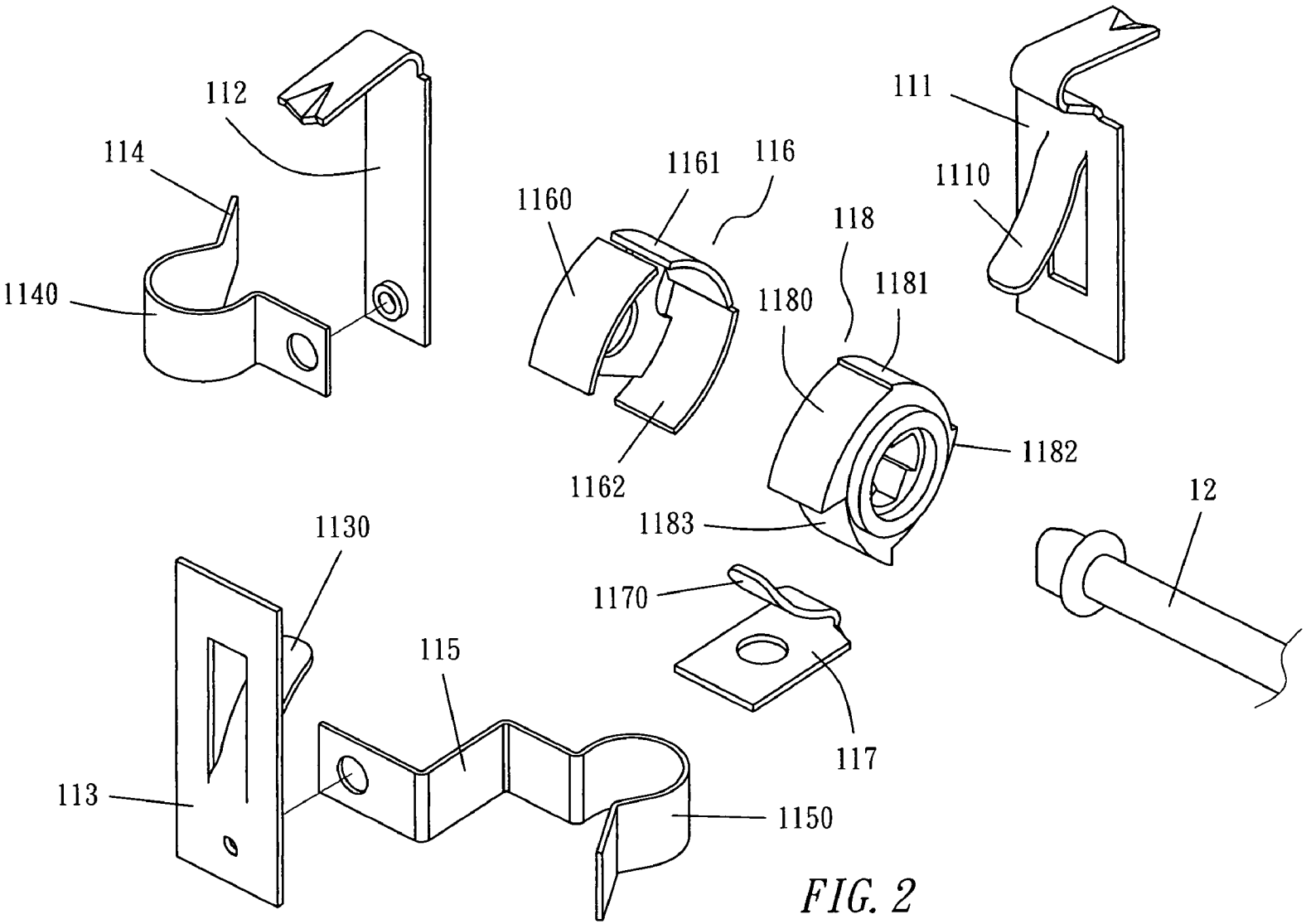
FIG. 2 is a three-dimensional exploded view of a partial structure of the exemplary embodiment of this invention.
Figure 3:
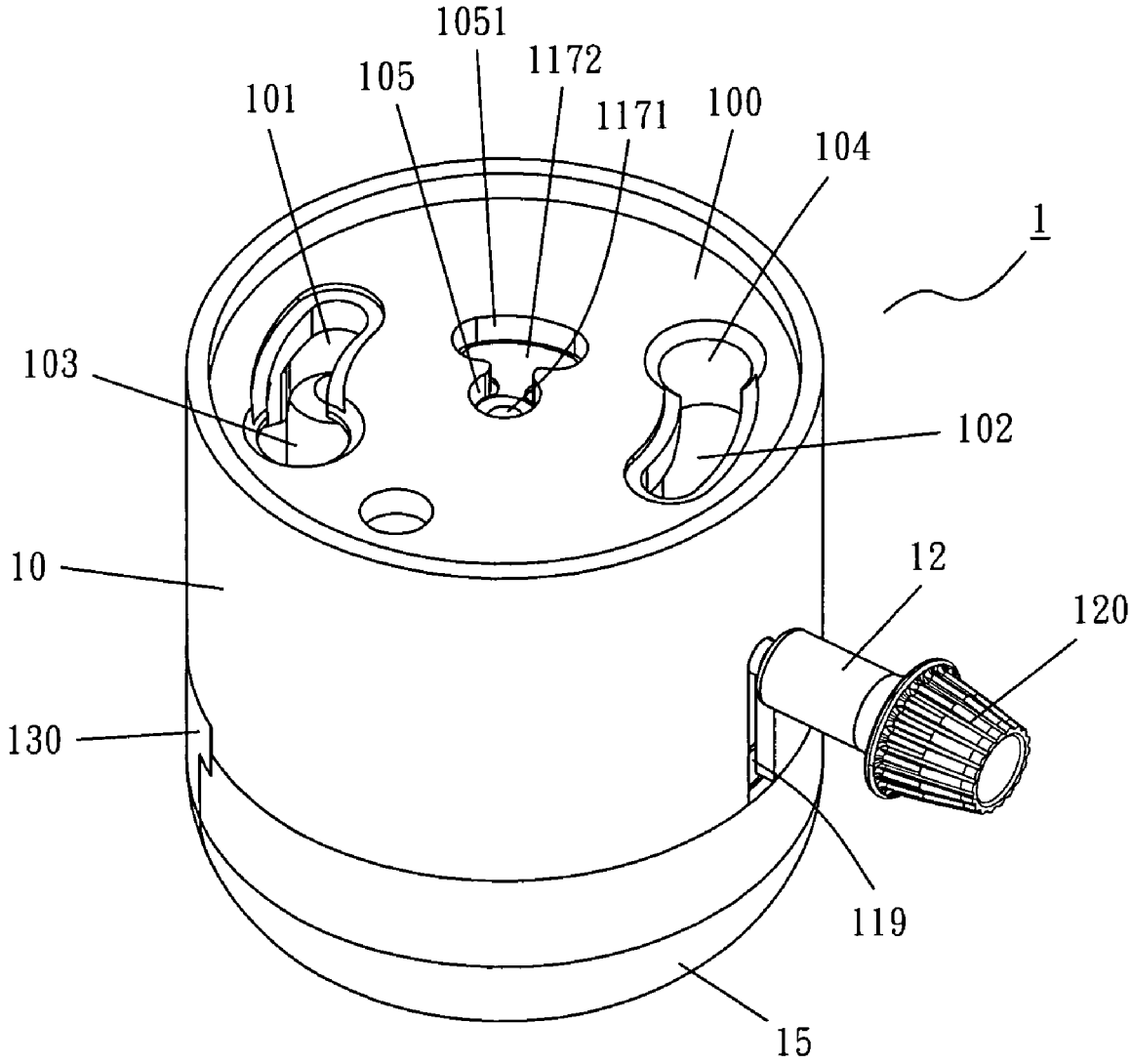
FIG. 3 is a three-dimensional top view of the exemplary embodiment of this invention.
Figure 4:
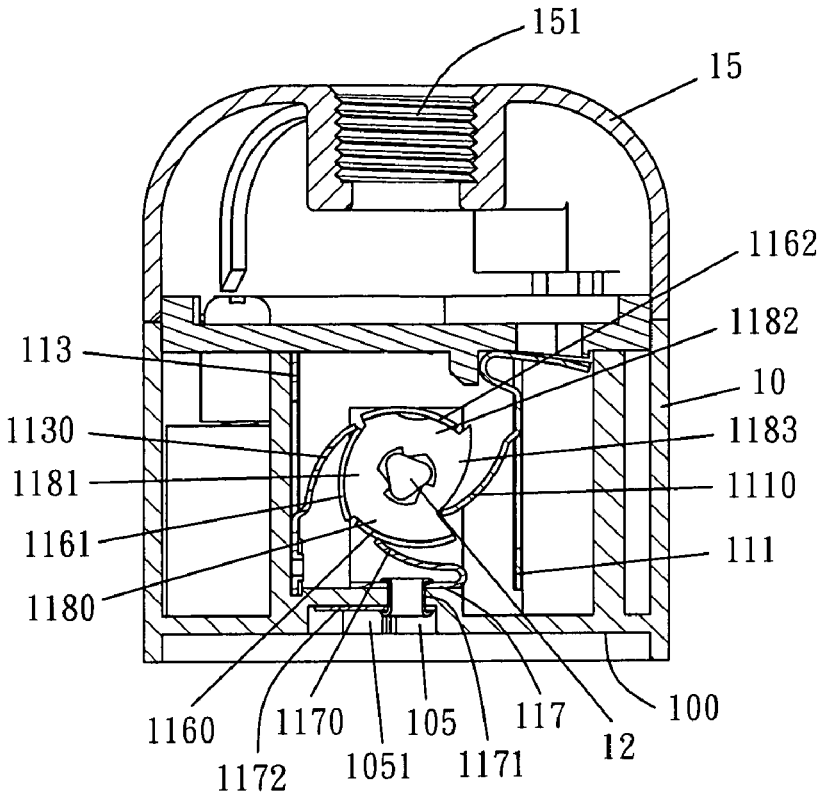
FIG. 4 is an assembled sectional view of the exemplary embodiment of this invention.

An exemplary embodiment of this invention is a lamp holder 1, a GU24 3-way dimmer knob-type switch lamp holder 1, referring to FIGS. 1~4, where the lamp holder 1 comprises:

a body 10, shown in FIG. 3, having a joining surface 100 at its bottom, where the joining surface 100 is provided with a set of symmetrical and curved guiding troughs, a first guiding trough 101 and a second guiding trough 102, and each joins a broadened hole 103, 104 at its one end. And the joining surface 100 is provided with a circular through trough 105 at its center and a broadened shallow trench 1051 connected for the positioning purpose. Shown in FIG. 1, the body 10 is provided with a lodging space 11 and a plurality of lodging troughs 110 for lodging an anode clasping plate 111, an electrode clasping plate 112, a first conducting plate 113, an electrode conducting plate 114, a second conducting plate 115, a rotor conducting plate 116, a third conducting plate 117 and an insulating rotor 118 respectively. Referring to FIG. 2, the rotor conducting plate 116 forms a cavity by a side wall and a curved wall, where the curved wall is divided into four parts, and three of them are arranged in the form of ratchets, which are shaped orderly into a first contact plate 1160, a second contact plate 1161 and a third contact plate 1162, and the forth part is void. The insulating rotor 118 is accommodated in the cavity of the rotor conducting plate 116 to form a firm combination, where the outer wall of the insulating rotor 118 is arranged in the form of ratchets, which are shaped into a first ratchet 1180, a second ratchet 1181, a third ratchet 1182 and a fourth ratchet 1183. During the assembly, referring to FIG. 4, the first ratchet 1180, the second ratchet 1181 and the third ratchet 1182 correspond to the first contact plate 1160, the second contact plate 1161 and the third contact plate 1162 respectively, and the fourth ratchet 1183 corresponds to the gaping void of the rotor conducting plate 116 to form a naked appearance. The rotor conducting plate 116 and the insulating rotor 118 are to combine to be accommodated in the lodging trough 110, which is located on top of the circular trough 105. Referring to FIGS. 2 & 4, the anode clasping plate 111 is provided with an arced contact plate 1110 that joins the curved wall of the rotor conducting plate 116, while the electrode clasping plate 112 joins one end of the electrode conducting plate 114 at its one end. The other end of the electrode conducting plate 114 is shaped into a curved joining portion 1140, which is right placed inside the first guiding trough 101 during the assembly. The first conducting plate 113 is provided with an arced contact plate 1130 that joins the curved wall of the rotor conducting plate 116 during the assembly, and the first conducting plate 113 joins one end of the second conducting plate 115 at its one end. The other end of the second conducting plate 115 is shaped into a curved joining portion 1150, which is right placed inside the second guiding trough 102 during the assembly. The third conducting plate 117 is provided with an arced contact plate 1170 that joins the curved wall of the rotor conducting plate 116, and the third conducting plate 117 is connected fixedly (fixed by a rivet) to the circular trough 105 by means of a linking piece 1171, where the linking piece 1171 joins a contact plate 1172 for the conduction purpose on the joining surface 100, to have the contact plate 1172 positioned in the shallow trench 1051. Referring to FIG. 1, the body 10 is provided with a slot 119 at its one side and with a fastening hole 1191 at each of two sides of the interior. A driving shaft 12 is connected to the center of the insulating rotor 118 for a firm combination with its one end, while the other end to a knob 120. The driving shaft 12 is placed in the slot 119 during the assembly; therefore, through the turning of the knob 120, the driving shaft 12 is able to drive the insulating rotor 118 and the rotor conducting plate 116 for synchronous rotation, which alters the contacts between the four portions of the rotor conducting plate 116: first contact plate 1160, the second contact plate 1161, the third contact plate 1162 and the void and the three contact plates: 1110, 1130 and 1170, for the adjustment of the luminance of light (detailed description afterward);

a fixing member 13, shown in FIGS. 1 & 4, having two opposite portions on its rim which are protruded to form clamping hooks 130, is provided with a set of through holes 131 and a set of cord holes 132 at its top surface. As the aforementioned parts are mounted in the body 10, the fixing member 13 is to put on top of the body 10, and a set of fastening articles 14 are used to penetrate the set of through holes 131 respectively and are joined to the corresponding fastening holes 1191 to form a firm combination (could be either a threaded means or a rivet means); and a top cover 15, shown in FIGS. 1 & 4, having a clamping trough 150 at each of the two sides of its outer wall corresponding to one clamping hook 130. Once the top cover 15 is placed right on top of the body 10 with the fixing member 13 in position, the clamping hooks 130 are inserted for being clamped by the corresponding clamping troughs 150 for a firm combination. The top cover 15 is provided with a connecting hole 151, better to be a threaded hole, which is handy for threaded joining with a supporting lamp frame (not shown in the figure), and the connecting hole 151 is also used for the passage by the power cords (not shown in the figure).

Figure 5:
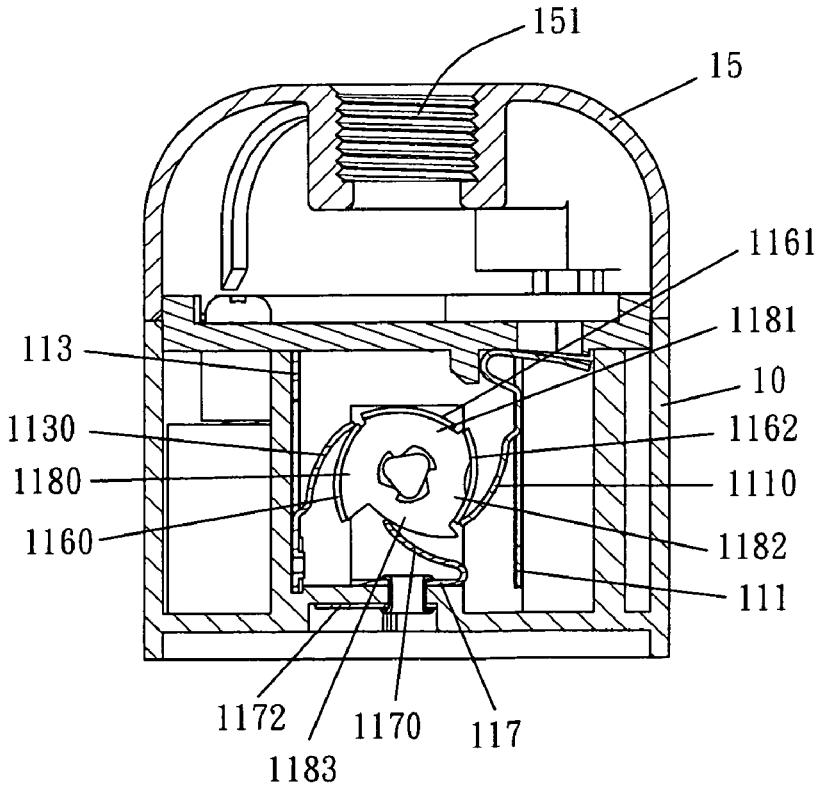
FIGS. 5~7 are diagrams illustrating the adjustment of luminance of light of the exemplary embodiment of this invention.
Figure 6:
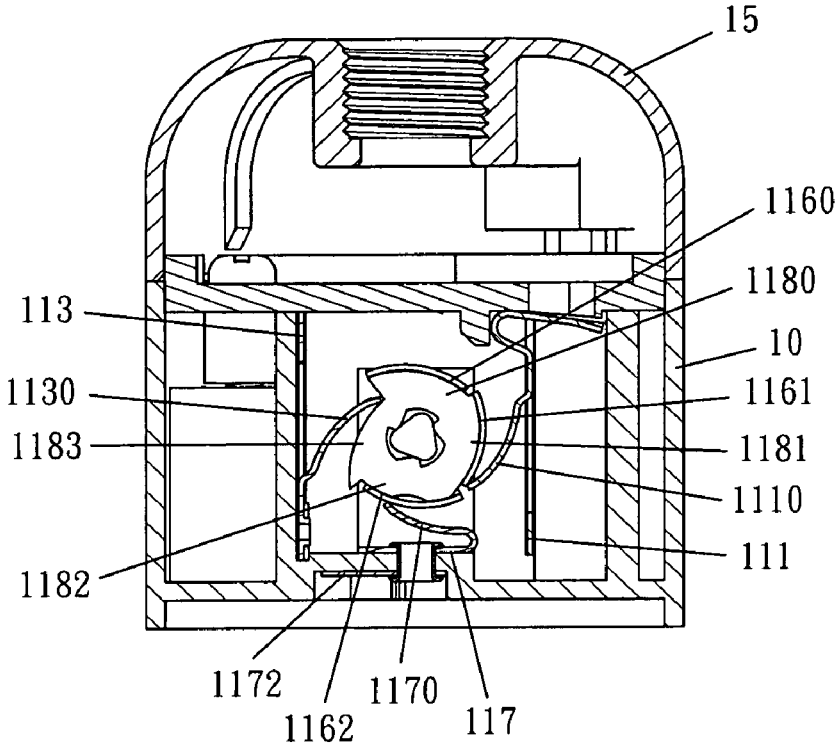
Figure 7:
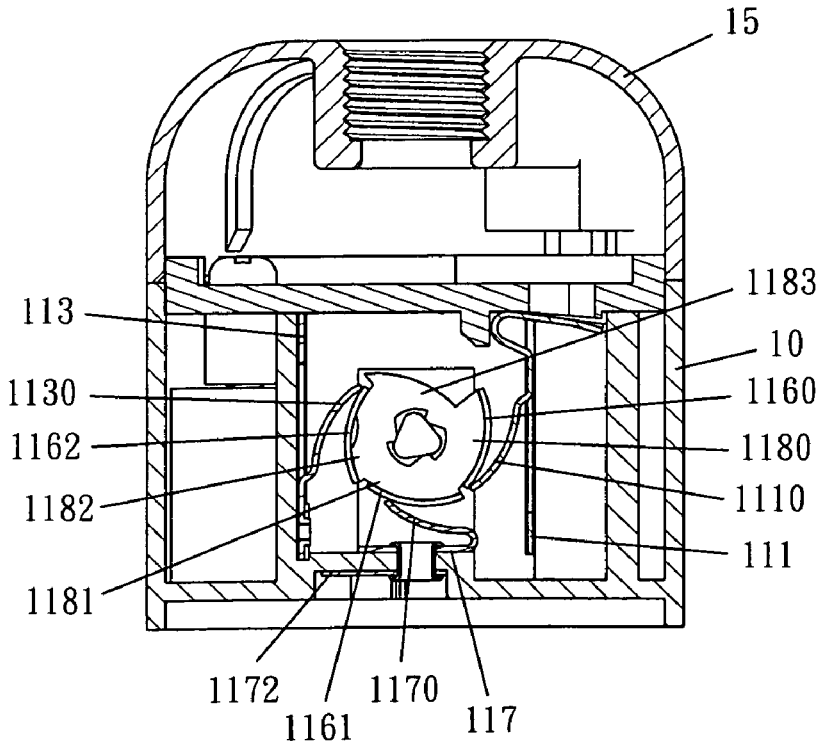

According to the aforementioned structural combination, once the assembly is accomplished, the power cords are available to be placed in through the connecting hole 151 and inserted in the cord holes 132 for a clamping with the anode clasping plate 111 and the electrode clasping plate 112 respectively for the completion of power connection. The electric current at one pole is conducted to the electrode conducting plate 114 through the electrode clasping plate 112, while the current at the other pole is conducted through the contact plate 1110 of the anode clasping plate 111 to the rotor conducting plate 116. As a user turns the knob 120 to drive the insulating rotor 118 and the rotor conducting plate 116 for rotation, four variations in state are shown in FIGS. 4~7, where:

a.) Referring to FIG. 4, since the contact plate 1110 of the anode clasping plate 111 joins the fourth ratchet 1183 of the insulating rotor 118 (rather than joining any of the first contact plate 1160, the second contact plate 1161, or the third contact plate 1162 of the rotor conducting plate 116), the anode clasping plate 111 fails to conduct the electric current to the desired object, so that the whole lamp holder 1 is in OFF state.

b.) FIG. 4 shows a state of the knob 120 while FIG. 5 shows another state of the knob 120 as it is turned 90 degrees clockwise, where the contact plate 1110 of the anode clasping plate 111 joins the third contact plate 1162, the contact plate 1130 of the first conducting plate 113 joins the first contact plate 1160, and the contact plate 1170 of the third conducting plate 117 joins the fourth ratchet 1183 of the insulating rotor 118. Because both of the first contact plate 1160 and the third contact plate 1162 are part of the rotor conducting plate 116, so that they conduct each other. The electric current will then flows from anode clasping plate 111 through the first conducting plate 113 to the second conducting plate 115 (not to the third conducting plate 117). Meanwhile, the electric current in the other pole of the power source is conducted through the electrode clasping plate 112 to the electrode conducting plate 114 for accomplishing the conduction. The joining portion 1140 of the electrode conducting plate 114 and the joining portion 1150 of the second conducting plate 115 are assembled into the first guiding trough 101 and the second guiding trough 102 of the joining surface 100 respectively. As in FIG. 8, the set of conducting poles 43 on the top of an energy saving lamp 4 are placed in the broadened holes 103, 104 respectively, followed by a twist through the first guiding trough 101 and the second guiding trough 102, until a touch to the joining portion 1140, 1150, which forms a closed loop to enable a first luminant (for instance: dim luminance) in the energy saving lamp 4 to light up, indicating the first luminance state.

c.) FIG. 6 shows the state of the knob 120 as it is turned 90 degrees clockwise from that in FIG. 5, where the contact plate 1110 of the anode clasping plate 111 joins the second contact plate 1161, the contact plate 1170 of the third conducting plate 117 joins the third contact plate 1162, and the contact plate 1130 of the first conducting plate 113 joins the fourth ratchet 1183 of the insulating rotor 118. Because both of the second contact plate 1161 and the third contact plate 1162 are part of the rotor conducting plate 116, so that they conduct each other. The electric current will then flows from anode clasping plate 111 through the third conducting plate 117 to the linking piece 1171 and the contact plate 1172. On the other hand, the electric current in the electrode clasping plate 112 is to be conducted to the electrode conducting plate 114. As the conducting poles 43 of the energy saving lamp 4 are placed in the broadened holes 103, 104 respectively, followed by a twist through the first guiding trough 101 and the second guiding trough 102, the conducting poles 43 will still join the joining portion 1140, 1150; however, there is the joining portion 1140 to be conducted to the corresponding conducting pole 43, whereas the joining portion 1150 is not conducted, so that the corresponding conducting pole 43 will not be conducted. To achieve 3-way dimmer function, the energy saving lamp 4 has to be altered somehow, as in FIGS. 8 & 9, where a flexible conducting head 45 is set up near the center of the top of the lamp. Once the energy saving lamp 4 and the lamp holder 1 are assembled, the conducting head 45 is placed in the shallow trench 1051 and electrically connected to the contact plate 1172. And the electric current is conducted from the third conducting plate 117 through the linking piece 1171 and the contact plate 1172 to the conducting head 45, and the current is further conducted to the circuit control device of the energy saving lamp 4, where the conducting head 45 and the selected conducting poles 43 is designed to form another closed loop that enables a second luminant (for instance: moderate luminance) in the energy saving lamp 4 to light up, indicating the second luminance state.

d.) FIG. 7 again shows the state of the knob 120 as it is turned 90 degrees clockwise from that in FIG. 6, where the contact plate 1110 of the anode clasping plate 111 joins the first contact plate 1160, the contact plate 1170 of the third conducting plate 117 joins the second contact plate 1161, and the contact plate 1130 of the first conducting plate 113 joins the third contact plate 1162. Since the first contact plate 1160, the second contact plate 1161 and the third contact plate 1162 each is part of the rotor conducting plate 116, so that they conduct one another. The electric current will then flows from anode clasping plate 111 through the third conducting plate 117 to the linking piece 1171 and the contact plate 1172, and the electric current is also conducted through the first conducting plate 113 to the second conducting plate 115, while the negative pole of the power source allows the passage of current through the electrode clasping plate 112 to the electrode conducting plate 114. Once the energy saving lamp 4 and the lamp holder 1 are assembled, both the two conducting poles 43 and the conducting head 45 are conducted to enable the two closed loops to operate simultaneously, which makes the first luminant and the second luminant in the energy saving lamp 4 to light up at the same time, indicating the third luminance state.

Figure 8:
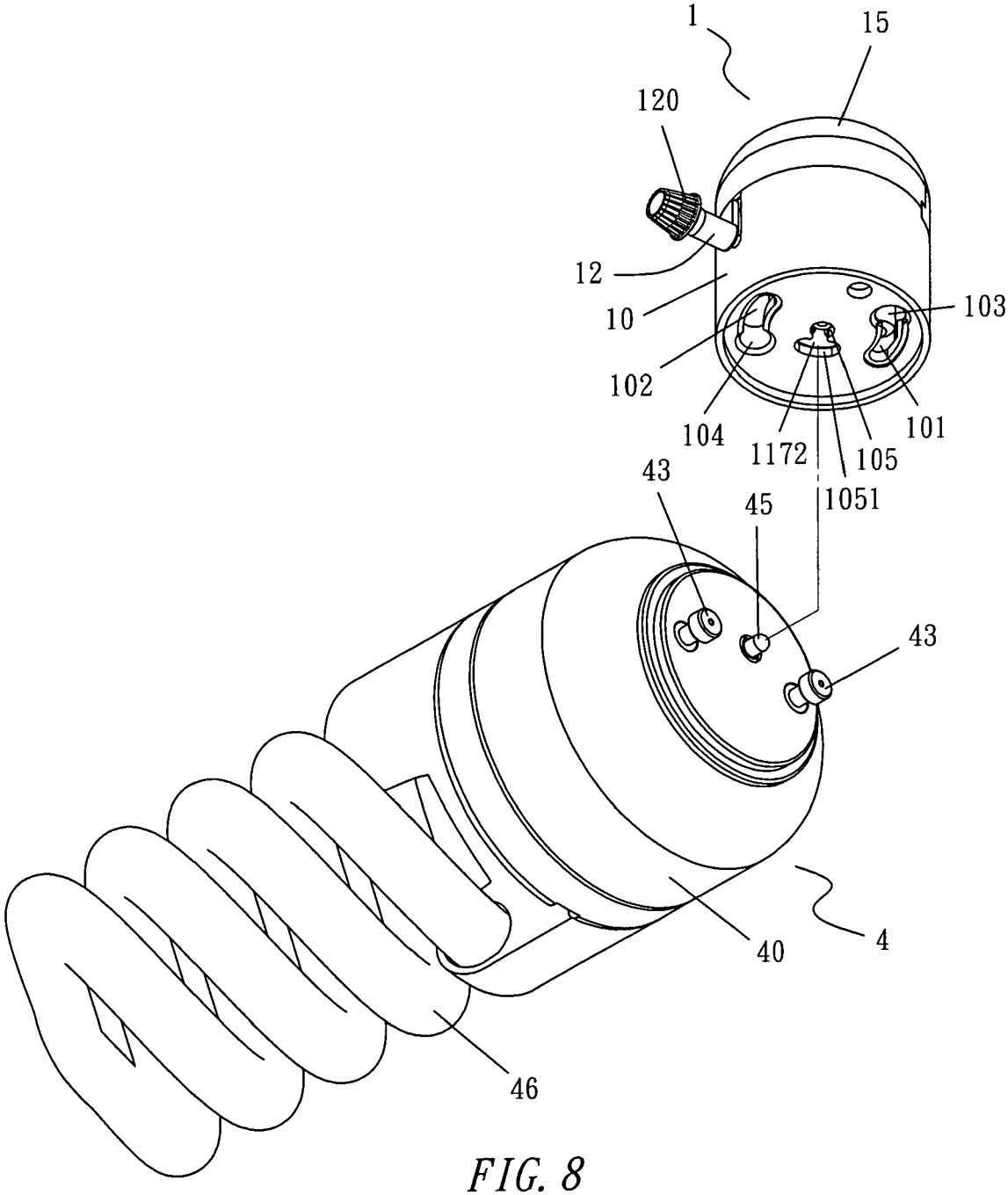
FIG. 8 is a three-dimensional exploded view of an accompanied energy saving fluorescent lamp with the exemplary embodiment of this invention.
Figure 9:
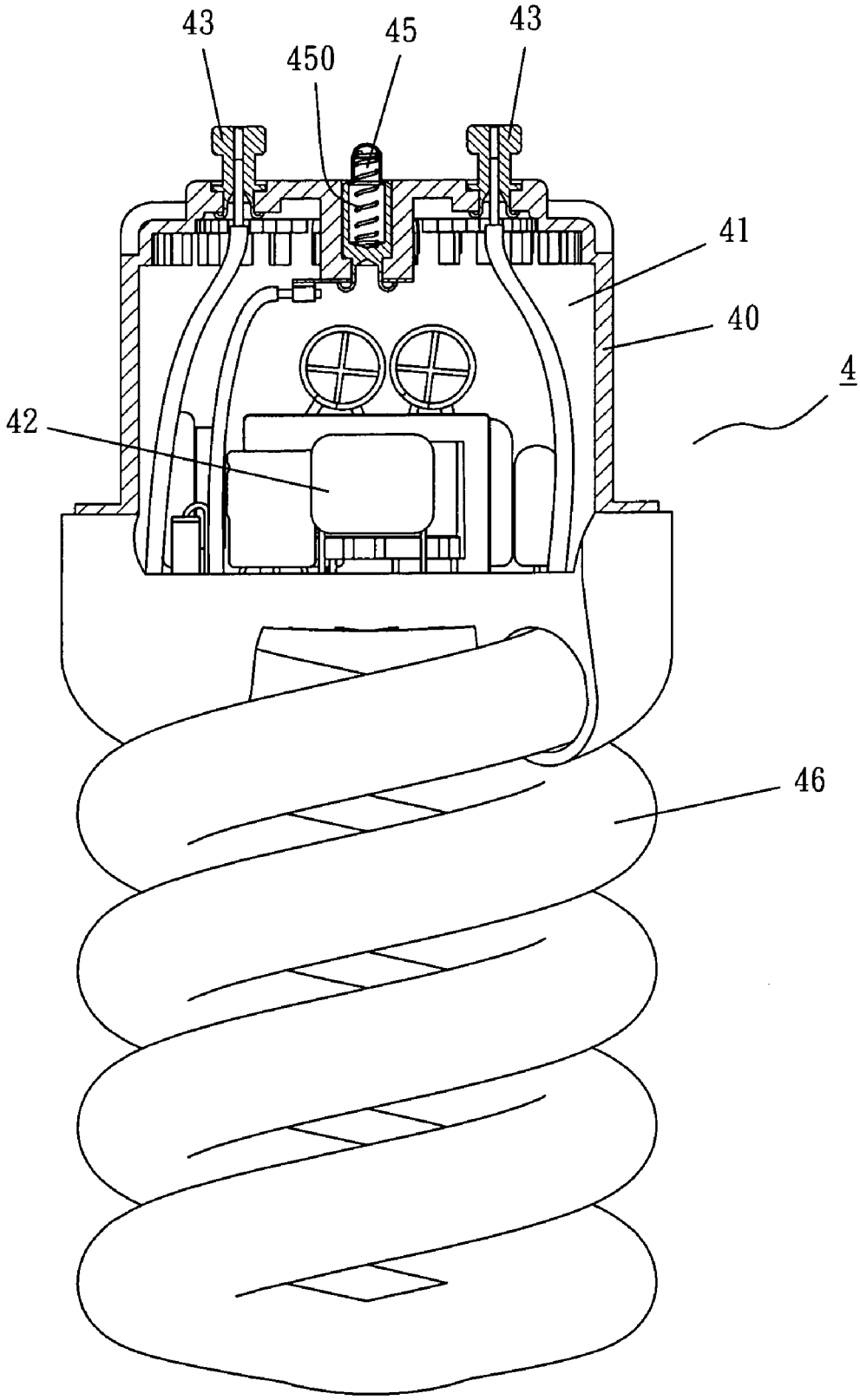
FIG. 9 is a sectional view of the partial of the accompanied energy saving fluorescent lamp with the exemplary embodiment of this invention.

The 3-way dimmer knob-type switch lamp holder 1 of this invention is used together with the GU24 3-way energy saving fluorescent lamp 4 shown in FIGS. 8 & 9, where the energy saving fluorescent lamp 4 has a cap 40 on its top and a chamber 41 in its interior for the accommodation of a circuit control device 42. The cap 40 has a set of conducting poles 43 in rivet fixing on its top and a conducting head 45 near the center of the top, and the bottom of the conducting head 45 is supported by an elastic member 450 corresponding to the contact plate 1172 of the lamp holder 1. The conducting poles 43 and the conducting head 45 each is electrically connected to the circuit control device 42 at its bottom. The cap 40 is mounted with a fluorescent tube 46 at its bottom. The circuit control device 42 of the energy saving fluorescent lamp 4 is designed to have two closed loops with different luminance. Once the energy saving fluorescent lamp 4 is mounted in the lamp holder 1, users are able to adjust the luminance of the energy saving fluorescent lamp 4 into low, moderate, high brightness and OFF state only by turning the knob 120. If the mounted energy saving fluorescent lamp is a regular energy saving fluorescent lamp, rather than the type of two closed loops with different luminance, it is still available for the regular one to mount on the lamp holder 1; however, the switching among low, moderate, high brightness and OFF state is no more available. It is merely an ON/OFF level of control.

Figure 10:
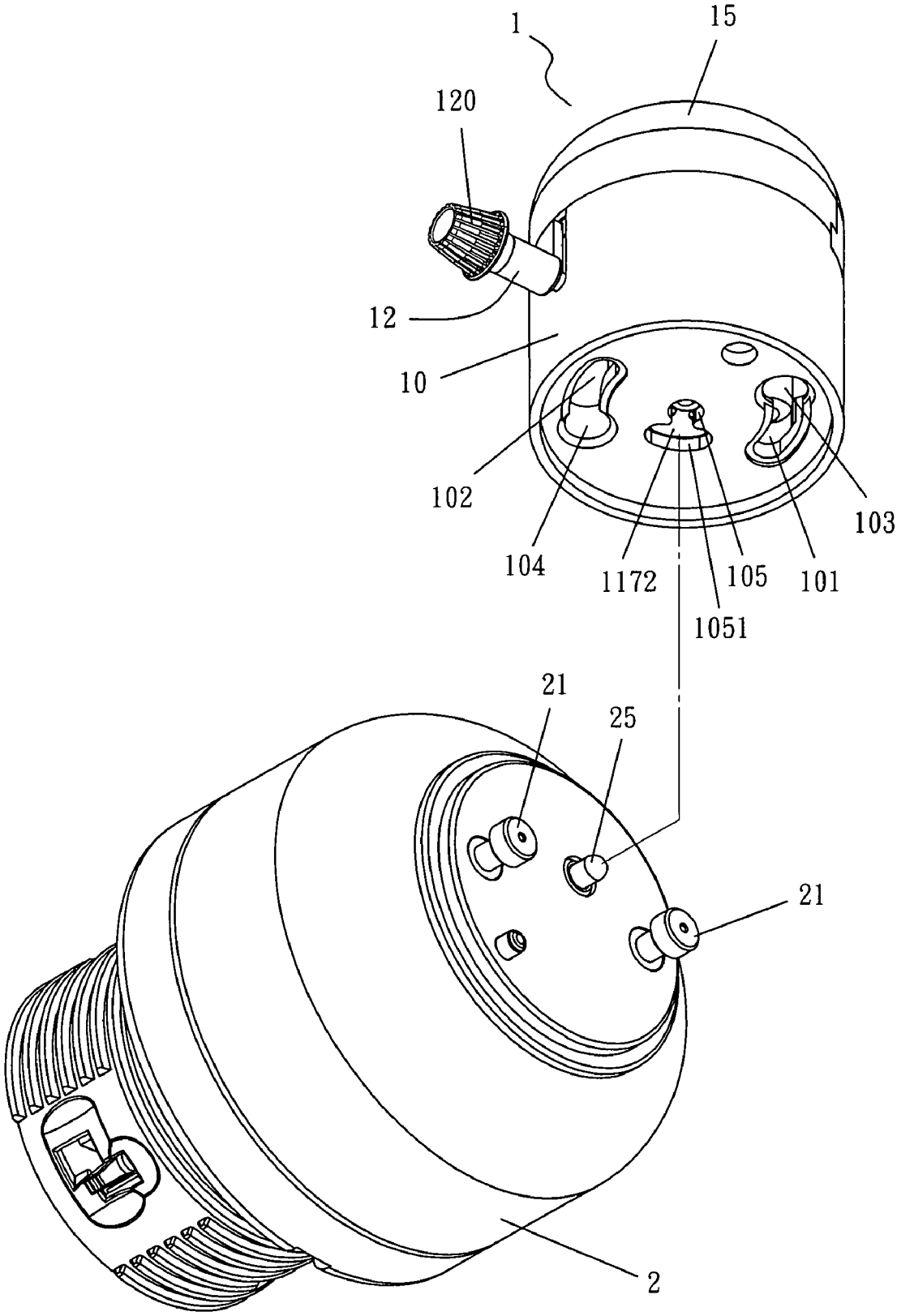
FIG. 10 is a three-dimensional exploded view of an adapter with the exemplary embodiment of this invention.
Figure 11:
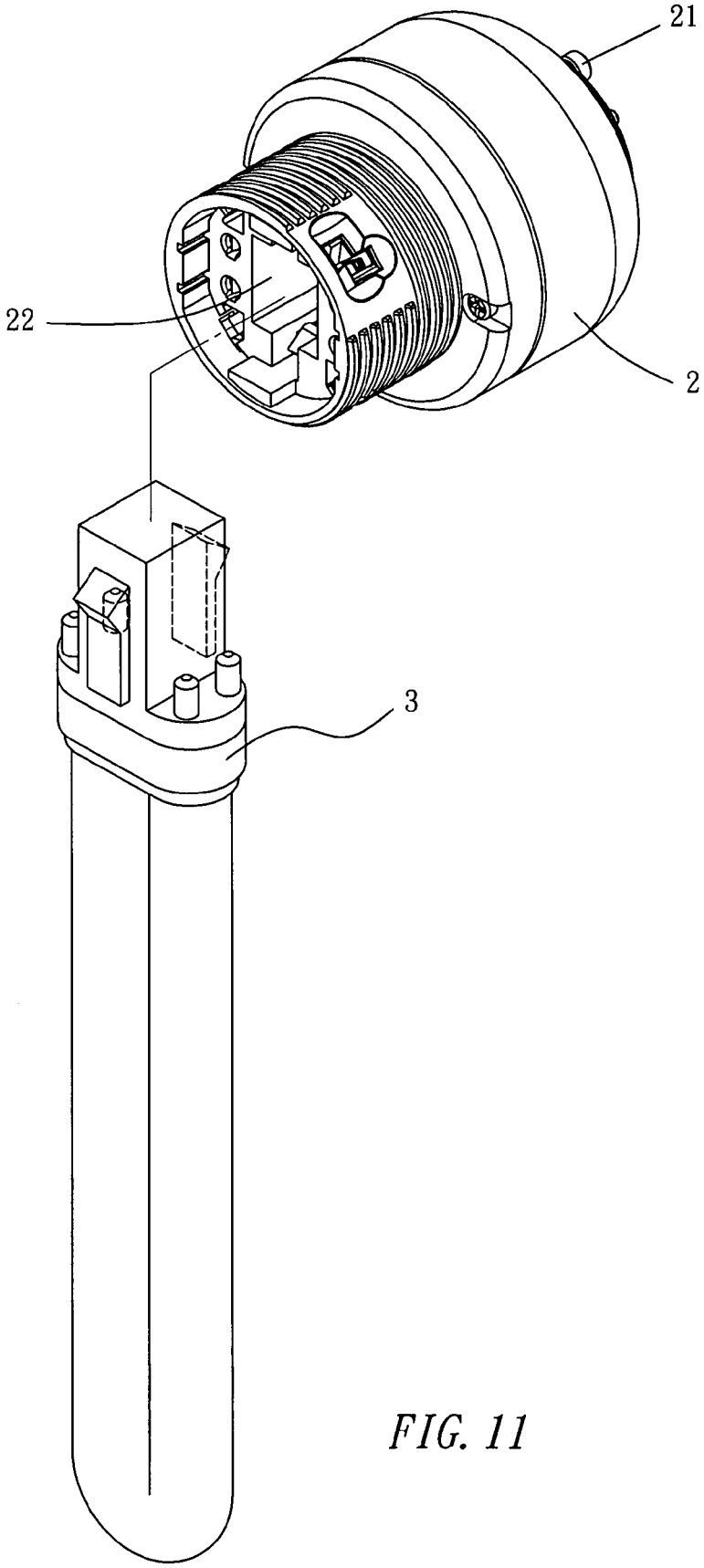
FIG. 11 is a three-dimensional exploded view of the adapter and a FL fluorescent lamp with the exemplary embodiment of this invention.

The use of the GU24 3-way dimmer knob-type switch lamp holder 1 of this invention is free to operate in coordination with the GU24 3-way energy saving fluorescent lamp 4; therefore, shown in FIGS. 10 & 11, the lamp holder 1 is first mounted by a adapter 2 that is provided with GU24 conducting poles 21 and a conducting head 25 on its top, followed by a PL fluorescent lamp 3 mounting in the socket 22 at the bottom of the adapter 2. Of course the circuit combining the adapter 2 and the PL fluorescent lamp 3 is designed to have two closed loops with different luminance for regulating the light. Users are then available to adjust the luminance of the PL fluorescent lamp 3 into low, moderate, high brightness and OFF state only by turning the knob 120.

Accordingly, this inventor claims a patent on the GU24 3-way dimmer knob-type switch lamp holder 1, where the GU24 energy saving fluorescent lamp featuring 3-way dimmer is the target lamp to be used. An embodiment of this invention is to drive the insulating rotor 118 and the rotor conducting plate 116 to rotate by turning the knob 120, where the contact plates 1110, 1130 and 1170, together with the first contact plate 1160, the second contact plate 1161, and the third contact plate 1162 of the rotor conducting plate 116 are arranged into different modes of conduction and no conduction, which enable various levels of illumination: dim, moderate and high brightness after power ON and also feature power OFF function. And this invention actually conforms to the following objectives: simplicity in structure, handiness in operation and energy saving and environmental protection.

It is essential to mention that GU24 energy saving fluorescent lamp and its associate GU24 energy saving lamp holder (no matter it has 3-way dimmer or not) has become an standard of American National Standards Institution (ANSI). The GU24 energy saving lamp holder is designated as the specialized lamp holder for the energy saving fluorescent lamps in the United States and Canada. And it has replaced Edison screw base lamp holder (for instance: E26) after the incandescent tungsten lamps are prohibited, and this is no doubt a worldwide trend of energy saving. Under this energy saving standard, the GU24 3-way dimmer knob-type switch lamp holder of this invention together with GU24 energy saving fluorescent lamps exceedingly conform to the energy saving standards, which would no doubt bring a reform to the lighting industry.

In conclusion, the present invention indeed accomplishes expected objective and function, and the disclosure of its structural combination has not opened to the public, which is construed to be valid for a patent; however, the aforesaid exemplified embodiments of the present invention are used only for the illustration, not for the constraint of the scope; any equivalent embodiments or modifications without departing from the spirit and scope of the present invention are therefore intended to be embraced.

What is claimed is:

1. A GU24 3-way dimmer knob-type switch lamp holder, comprising: a body, having a joining surface at its bottom, where the joining surface is provided with a set of guiding troughs to be inserted firmly by conducting poles of the GU24, and having a circular through trough at its center and a broadened shallow trench connected for the positioning purpose, the body being provided with a plurality of lodging troughs for lodging an anode clasping plate, an electrode clasping plate, a first conducting plate, an electrode conducting plate, a second conducting plate, a rotor conducting plate, a third conducting plate and an insulating rotor, where the rotor conducting plate forms a cavity by a side wall and a curved wall, the curved wall being divided into four parts, where three of them are arranged in the form of ratchets, which are shaped orderly into a first contact plate, a second contact plate and a third contact plate, and the forth part being void, the insulating rotor being accommodated in the cavity of the rotor conducting plate in a firm combination, where its outer wall is arranged in the form of ratchets which are shaped into a first ratchet, a second ratchet, a third ratchet and a fourth ratchet, where the first ratchet, the second ratchet and the third ratchet correspond to the first contact plate, the second contact plate and the third contact plate respectively, and the fourth ratchet corresponds to the gaping void, the anode clasping plate being provided with a contact plate that joins the curved wall of the rotor conducting plate, while the electrode clasping plate joins the electrode conducting plate, one end of the electrode conducting plate being shaped into a curved joining portion, which is placed inside a guiding trough during the assembly, the first conducting plate being provided with a contact plate that joins the curved wall of the rotor conducting plate, and the first conducting plate joining the second conducting plate, one end of the second conducting plate being shaped into a curved joining portion, which is placed inside another guiding trough during the assembly, the third conducting plate being provided with a contact plate that joins the curved wall of the rotor conducting plate, and the third conducting plate being connected fixedly to the circular trough by means of a linking piece, where the linking piece joins a contact plate for the conduction purpose on the joining surface, to have the contact plate positioned in the shallow trench, the body being provided with a slot at its one side and with a fastening hole at each of two sides of the interior, a driving shaft being connected to the center of the insulating rotor with its one end for a firm combination, while the other end of the shaft to a knob, and the driving shaft being placed in the slot during the assembly;

a fixing member, having two opposite portions on its rim protruded into forming clamping hooks, being provided with a set of through holes and a set of cord holes at its top surface, the fixing member being to put on top of the body, and a set of fastening articles being used to penetrate the set of through holes respectively and being joined to the corresponding fastening holes of the body; and a top cover, having a clamping trough at each of the two sides of its outer wall corresponding to the clamping hook of the fixing member, once the top cover is placed right on top of the body with the fixing member in position, the clamping hooks being inserted for clamping by the corresponding clamping troughs, the top cover being provided with a connecting hole for joining with a supporting lamp frame and for the passing through by the power cord;

when in use, through the turning of the knob, the driving shaft being able to drive the insulating rotor to rotate synchronously with the rotor conducting plate, which alters the relative contacts between the four portions of the rotor conducting plate: first contact plate, the second contact plate, the third contact plate and the void and the three objects: the contact plate of the anode clasping plate, the contact plate of the first conducting plate and the contact plate of the third conducting plate, the joining portion in the guiding trough of the joining surface of the body and the contact plate joined with the linking piece work together with the lamp to feature the adjustment of the light into three states of illumination: dim, moderate, and high brightness and power OFF.

2. A GU24 3-way dimmer knob-type switch lamp holder as in claim 1 where the lamp holder is used together with the GU24 3-way energy saving fluorescent lamp, and the energy saving fluorescent lamp having a cap on its top and an internal chamber for the accommodation of a circuit control device, the cap having a set of conducting poles in rivet connection on its top and a conducting head near the center of the top, and the bottom of the conducting head being supported by an elastic member corresponding to the contact plate of the lamp holder, the conducting poles and the conducting head each being electrically connected to the circuit control device at its bottom portion, the cap being mounted with a fluorescent tube, the circuit control device being provided with two closed loops with different luminance, once the energy saving fluorescent lamp being mounted in the lamp holder, users being able to adjust the luminance of the energy saving fluorescent lamp into low, moderate, high brightness and an OFF state only by turning the knob.

* * * * *